United States Patent [19]

Wood et al.

[11] 4,074,839

[45] Feb. 21, 1978

[54] INTERNAL FRAME BACKPACK

[76] Inventors: Thomas E. Wood; Calvin T. Wood, both of 3863 42nd NE., Seattle, Wash. 98105

[21] Appl. No.: 684,566

[22] Filed: May 10, 1976

[51] Int. Cl.[2] ..... A45F 3/08

[52] U.S. Cl. ..... 224/8 R; 224/25 A

[58] Field of Search ..... 224/8 R, 8 A, 25 A, 224/43, 44, 32 A, 32 R, 26 R, 9, 10, 5 P, 5 N, 5 R; 150/31, 28 R, 14, 1; 190/41 R, 51, 52

[56] References Cited

U.S. PATENT DOCUMENTS

| | | | |
|---|---|---|---|
| 2,421,244 | 5/1947 | Daiber | 224/25 A |
| 3,679,108 | 7/1972 | Ingram | 224/8 R |

FOREIGN PATENT DOCUMENTS

| | | | |
|---|---|---|---|
| 516,153 | 12/1952 | Belgium | 224/8 R |
| 118,304 | 3/1947 | Sweden | 224/8 R |
| 39,872 | 12/1915 | Sweden | 224/8 R |
| 191,988 | 7/1937 | Switzerland | 224/8 R |
| 194,616 | 12/1937 | Switzerland | 224/8 R |

*Primary Examiner*—Robert J. Spar
*Assistant Examiner*—Jerold M. Forsberg
*Attorney, Agent, or Firm*—Graybeal, Barnard & Uhlir

[57] ABSTRACT

A backpack is disclosed having a sack including a stowage compartment and a frame holding compartment comprising an envelope having a front wall positionable against the wearer's back. A flexible unitary frame is positionable within the frame receiving envelope, under compression, and longitudinally tensions the front wall of the envelope. The unitary frame includes curved end portions interconnected by a pair of inwardly bowed, generally C-shaped side portions. The curved end frame portions fit the like curved closed end portions of the frame receiving envelope. The flexible frame is arcuate longitudinally and has a concave intermediate portion thus allowing inward movement of the tensioned front wall when contacted by the back of the wearer. Movement of the tensioned front wall causes the backpack to "hug" or closely fit the curvature of the wearer's back and thus moves the center of gravity of the backpack closer to the wearer's back to improve backpack balance. The portion of the front wall in contact with the wearer's back is formed from an open weave mesh allowing air to circulate over the back of the wearer.

9 Claims, 7 Drawing Figures

Fig. 1.
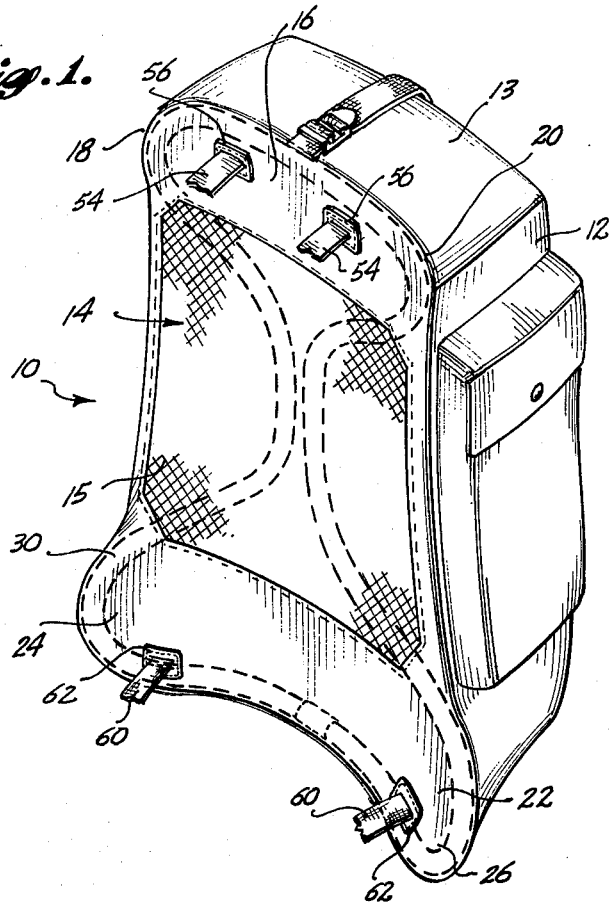
Fig. 2.
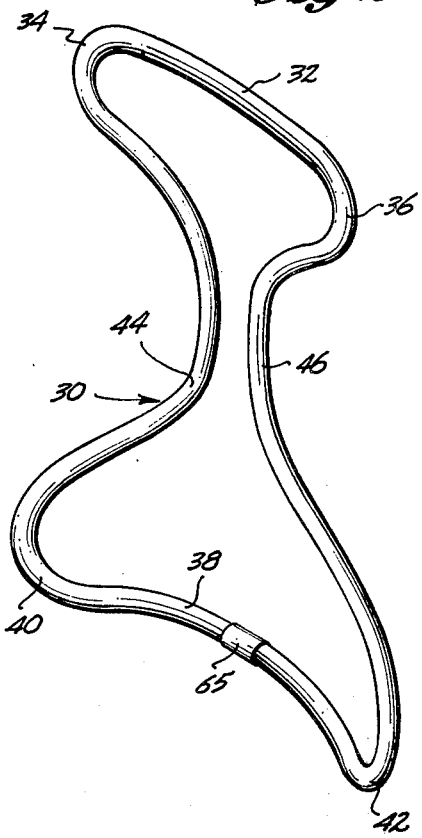
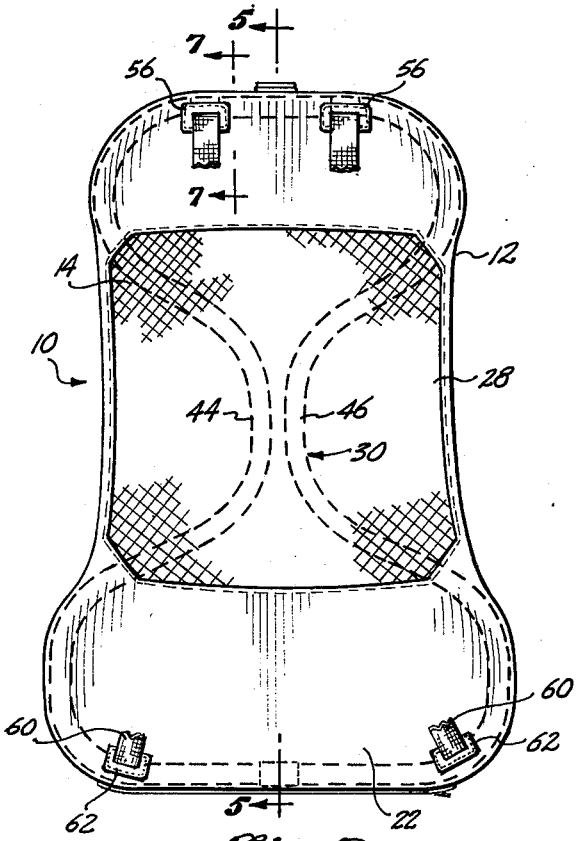
Fig. 3.
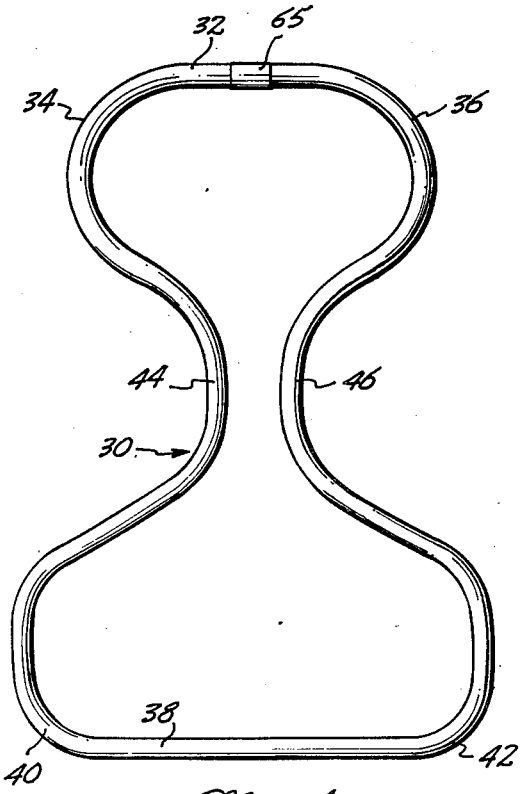
Fig. 4.

INTERNAL FRAME BACKPACK

BACKGROUND OF THE INVENTION

1. Field of the Invention

This invention relates to a backpack used to carry a load on the back of a wearer, and more particularly, to a backpack having an enclosed envelope including a front wall positionable against the wearer's back and a compressively stressed internal frame disposed within the envelope tensioning the front wall.

2. Description of the Prior Art

Backpacks have been used for many years to assist humans in transporting loads on their backs. Backpacks have included sacks having one or more compartments for the stowage of various articles, and often a frame has been provided to add strength and rigidity to the sack as it is held in position on the back of the wearer by shoulder straps or the like.

One such pack shown in U.S. Pat. No. 2,421,244 includes a frame having a pair of upright side rails and a plurality of arcuate cross frame members interconnected in a vertically spaced arrangement. The length of the cross members decreases from bottom to top causing the frame to taper inwardly. A like tapered fabric sheet is provided over the frame and is open at the bottom.

U.S. Pat. No. 3,860,157 discloses a backpack having a readily disassembled frame which is held together by netting wrapped around the upright side frame members.

In addition to the above described prior art, U.S. Pat. No. 3,734,366, granted May 22, 1973 and pending patent application Ser. No. 588,795, filed June 20, 1975, disclose backpacks employing a lightweight pack frame constructed of rigid polyvinyl chloride or the like.

SUMMARY OF THE INVENTION

According to one aspect of the invention, an improved backpack is provided having a deformable front wall positionable against the back of the wearer. A sack is provided with an envelope which has closed peripheral edges. A flexible, unitary frame is placed within the enclosed envelope, under compression, thereby tensioning the front wall of the backpack.

According to another aspect of the invention, a backpack is provided with an envelope on the front of the packsack which is positionable against the back of the wearer. The front wall of the envelope is formable in response to the shape of the wearer's back thus allowing the center of gravity of the loaded backpack to be positioned close to the wearer's back improving backpack balance. A closable opening is provided in the lower edge of the envelope through which a flexible frame is inserted. A zipper fastener closes the opening and compressively loads the frame thereby tensioning the front wall of the envelope.

According to yet another aspect of the invention, a backpack is provided with a sack including a contoured frame receiving envelope, and a contoured frame compressively stressed within the envelope which tensions the front wall. The one-piece frame includes generally U-shaped upper and lower end portions which are fitted to the opposed upper and lower closed peripheral ends of the envelope. The central portions of the frame are generally C-shaped and are inwardly curved toward each other. The entire unitary frame is arcuate or bowed longitudinally to provide space for the inward deflection of the front wall by the wearer's back without allowing the wearer's back to contact the frame itself.

According to still another aspect of the invention, a backpack is provided with a pair of shoulder straps attached to an internal frame without the use of pins or other devices requiring the forming of holes in the frame member. A laterally spaced pair of openings are located near the upper and lower ends of the front wall of the enclosed envelope and the ends of a pair of shoulder straps pass through the openings and are looped around the transverse end portion of the internal frame.

These and other advantages and objects of the present invention will become apparent upon reading the following specification and referring to the accompanying drawings in which simple characters of reference represent corresponding parts of the several view.

BRIEF DESCRIPTION OF THE DRAWINGS

FIG. 1 is a perspective view of the backpack constructed in accordance with the instant invention, the internal frame being shown in broken line within a portion of the sack;

FIG. 2 is a perspective view of the internal frame;

FIG. 3 is a front elevation view of the backpack of FIG. 1 illustrating the internal frame, in broken line, under compression in the closed envelope of the sack;

FIG. 4 is a front elevation view of the internal frame of FIG. 3 showing the frame in its uncompressed condition;

DESCRIPTION OF THE PREFERRED EMBODIMENTS

Figure 5:
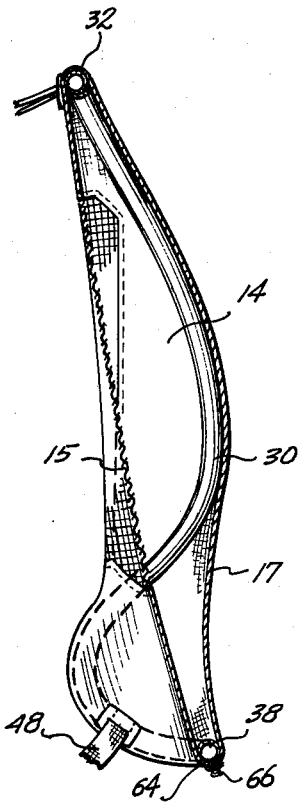
FIG. 5 is a section view taken along lines 5—5 of FIG. 3.

Referring initially to FIGS. 1 and 3, a backpack 10 is disclosed including a sack portion 12 having at least one compartment 13 in which goods to be carried may be stored. An additional compartment or envelope 14 is formed on the front of sack 12 by a front wall 15 which is sewn to the similarly shaped front wall 17 (FIG. 5) of sack 12. The peripheral edges of envelopes 14 are completely closed except for a closable opening through which a resilient frame to be described hereafter may be inserted.

In preferred form, front wall 15 is fabricated from three separate panels which are interconnected along adjacent edges by conventional means such as sewing or the like. Top panel 16 has a curved outer edge including corner portions 18 and 20, which when sewn to the like curved outer edge of front panel 17 of sack 12 gives envelope 14 a curved upper edge which, as will be discussed hereafter, cooperates with the like curved end of the internal frame. Bottom panel 22 of front wall 15 also has a curved outer edge portion including corners 24 and 26 which cooperate with the bottom portion of the front panel 17 of the sack to give envelope 14 a curved bottom edge which cooperates with a similarly curved bottom end of the internal frame which may be positioned within the envelope. As illustrated, panel 28 forms the middle portion of front wall 15, and it will be understood that with the backpack in position on the back of a wearer it is this portion of the front wall which contacts the wearer's back. It will, of course, be understood, that front wall 15 may also be formed from a single piece of material having a peripheral shape generally the same as the peripheral shape of the front wall 17 of sack 12.

Referring additionally to FIG. 2, a tubular frame member 30 is disclosed having curved upper and lower portions 32 and 38. Upper portion 32 includes curved corners 34 and 36, while lower portion 38 includes curved corners 40 and 42. The narrowed central portion or waist of frame 30 is formed by the curvature towards each other of frame portions 44 and 46. As seen in FIG. 4, the longitudinal ends of frame 30 are generally U-shaped, while the central portions 44 and 46 of the frame may be described as generally C-shaped, the backs of the C's being adjacent each other. FIG. 2 additionally discloses the lateral curvature of the lower portion of the frame whereby the frame partially surrounds the wearer's hips. As best seen in FIG. 5, the waist portion of frame 30 is also arcuately curved in the longitudinal direction and thus when frame 30 is enclosed within envelope 14, front wall 15 is not only stretched laterally by the upper and lower portions of the frame, but is also tensioned longitudinally in response to the longitudinal compression of the resilient frame.

Referring additionally to FIGS. 3 and 4, it will be seen that when internal frame 30 is positioned with envelope 14 the frame acts in a conventional manner as a load bearing member for backpack 10, and at the same time further functions in conjunction with envelope 14 as a biased spring member to tension front wall 15 of envelope 14. While the width of the curved upper and lower portions of frame 30 are generally equal to the widths of the corresponding portions of envelope 14, the height or length of frame 30 prior to its insertion within envelope 14 is slightly greater than the substantially fixed length of the envelope and thus frame 30 is longitudinally compressed by the envelope. It will be understood that the fabric materials used to form sack 12 and envelope 14 are for the most part of the conventional type used in backpacks, and are thus of a relatively inelastic and non-stretchable nature as compared with resilient and compressible frame 30. The open weave mesh material which forms the central panel 28 in the preferred embodiment of the invention, while not previously known to have been used in backpacks of the present type, is also of a relatively non-resilient and non-stretchable character as compared to frame 30.

Figure 6:
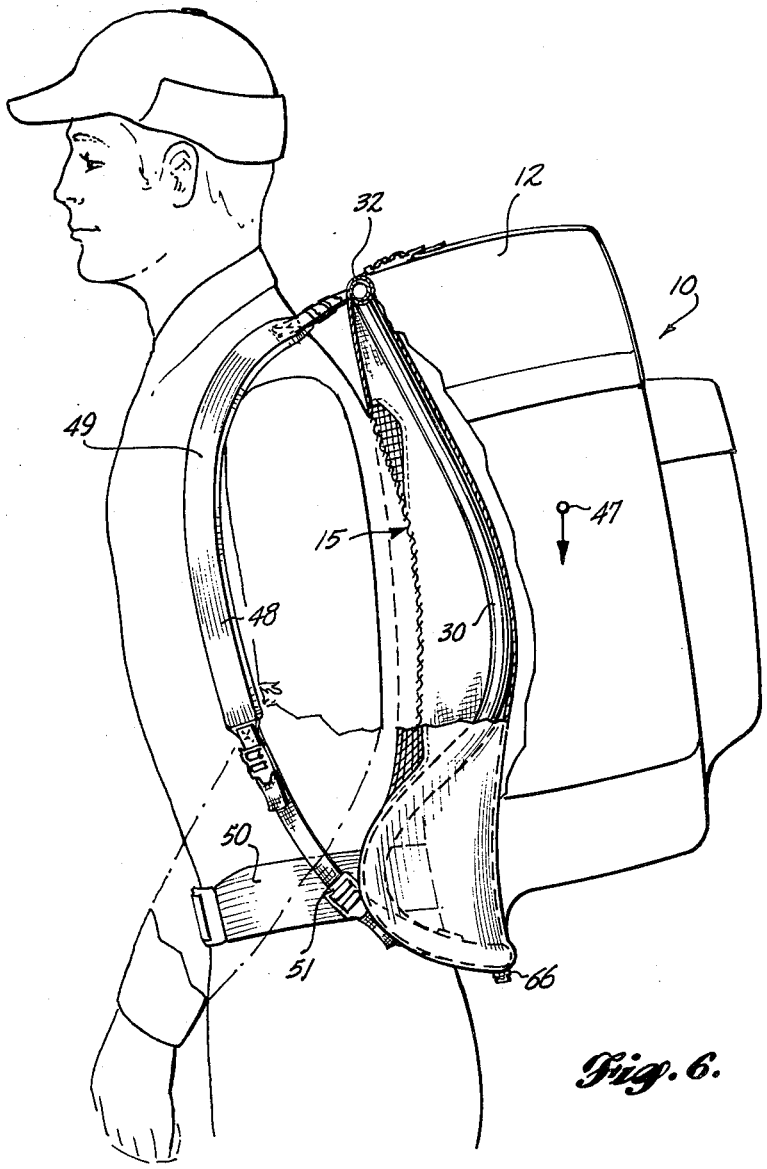
FIG. 6 is a partial, sectional side elevational view of the backpack of FIG. 1 shown on the back of a wearer.

Comparing FIGS. 3 and 4, it wll be noted that the waist portions 44 and 46 of the resilient frame 30 are moved toward each other by the compression of frame 30 within envelope 14. This movement allows upper and lower frame portions 32 and 38 to also move toward each other so that the frame can accommodate itself to the lesser length of envelope 14. Such longitudinal compression also results in slightly increased longitudinal curvature or arching of the waist portion of frame member 30. Referring additonally to FIGS. 5 and 6, it will be seen that the longitudinal curvature of the resiliently loaded frame 30 is such that even when front wall 15 is deformed rearwardly by mounting against the back of a wearer, space is maintained between wall 15 and frame 30 which prevents contact between the wearer's back and the frame member.

The unique and complex shape and curvature of frame 30 in combination with the related edge curvature of the top and bottom portions of envelope 14, as previously discussed, allow front wall 15 to be tensioned between the spaced end portions of the internal frame. Since the wearer's back makes principal contact with the central panel 28 of front wall 15 the deformation of the front wall by the wearer's back allows a portion of the load of the backpack to be distributed over the curvature of the wearer's back. In addition, the deformation of front wall 15 allows frame 30 and the entire load carried within sack 12 to move closer to or "hug" the wearer's back thus resulting in both improved load transfer to the wearer and improved weight balance of the pack on the wearer.

Referring specifically to FIG. 6, it will be assumed that the center of gravity of loaded backpack 10 may be represented by the downwardly extending arrow 47. Backpacks with good load transfer and weight balance characteristics have their center of gravity as close as possible to the wearer's back thus minimizing the length of the moment arm through which the force of gravity acts on the pack to tip the wearer backward. The movement of front wall 15 toward the internal frame in response to the wearer's back pressing thereagainst in the instant pack frame decreases the moment arm of the force of gravity thus providing a pack which is not only comfortable to wear but additionally provides improved transfer of weight from the loaded pack to the wearer.

Figure 7:
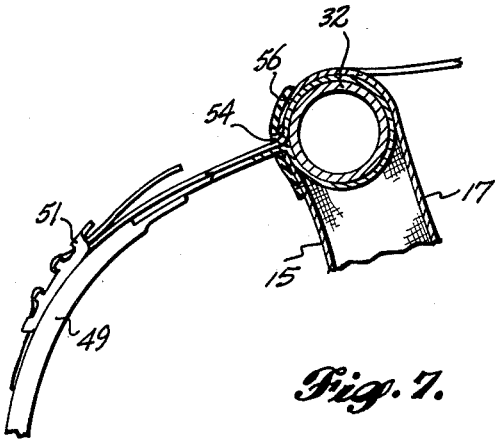
FIG. 7 is an enlarged section view taken along lines 7—7 of FIG. 3 illustrating the upper end of a shoulder strap wrapped around the internal frame and further including an adjustable buckle member on said strap.

Referring now to FIGS. 6 and 7, it will be seen that shoulder straps 48 are provided to hold the backpack against the back of the wearer, each strap including a conventional shoulder pad 49. Straps 48 may extend between the upper portion 32 of frame 30 and the lower portion 38 thereof. A hip belt 50 may alternatively be provided with the lower end of each shoulder strap 48 being secured thereto. As is best seen in FIG. 7, the upper end portion of each strap is inserted into a slit-like opening 54 in front wall 15 (see FIG. 1) and looped around portion 32 of the internal frame. The end of the strap is then brought back through opening 54 and is held by conventional buckle 58 attached to the shoulder strap, thus allowing for adjustment of the length of the shoulder strap. Reinforcing material 56 may be provided around each opening to prevent ripping or tearing of the front wall during use.

In one embodiment, the lower ends of straps 48 are fastened to the lower portion 38 of the internal pack frame in the same manner as discussed above with respect to the upper portion 32 of the frame. Alternatively, however, a hip belt 50 may be positioned around the hips of the wearer slightly above the level of lower frame portion 38, in which case the lower end of shoulder straps 48, or an extension thereof 60, after being inserted through slit-like opening 62 (FIG. 1), around frame portion 38, and returned out of opening 62, may be secured to buckles 51 located near the top of either side of hip belt 50.

As has been discussed heretofore, internal frame 30 is oversized as compared to envelope 14 such that the frame is under compression when enclosed within envelope 14 thus loading or stressing the peripheral edges of the envelope in a longitudinal direction. In order to position frame 30 in envelope 14, the frame is compressed or prestressed longitudinally to shorten its length. As seen in FIG. 5, in one embodiment a closable opening 64 is provided in the lower peripheral edge of envelope 14 adjacent the lower end of front wall 15. A zipper 66 may be provided to close the opening after the internal frame has been inserted into envelope 14 but will be understood that other known fastening techniques could also be used to close the opening while maintaining frame 30 in its compressively stressed condition. The use of a zipper closed opening allows ready access to frame 30 should replacement of either the frame or shoulder straps 48 which encircle the frame become necessary.

In addition to the comfort and improved load carrying functions of internal frame 30 and its cooperating envelope 14 having a tensioned front wall 15, it is believed that the prestressing of internal frame 30 within envelope 14 allows the pack frame to better resist collapse under the compressive loads exerted thereon by goods stored for carrying in sack 12. Other advantages not presently fully understood by applicants are provided by applicants' unique prestressed frame and enclosed envelope design, these advantages contributing cumulatively to the strength, lightness and comfort of applicants' backpack during use. For example, the ability of tensioned front wall 15 to change shape depending on the ever changing curvature of the wearer's back is believed to be important not only in terms of comfort, but also in terms of improved transfer of the shifting weight of the pack to the wearer's back.

In preferred form, central portion 28 of front wall 15 is fabricated from nylon seine or a like open weave material. This open weave material or netting allows air to circulate freely and continuously through envelope 14 thus allowing perspiration generated on the wearer's back to be dissipated by evaporation thus reducing a common source of discomfort in many prior backpacks.

In one embodiment of the present invention, internal frame 30 is molded to its unique shape from a single piece of 60 inch long PVC tubing having a ⅞-inch outside diameter. It will be understood, however, that many other types of extrudible plastic or metal tubing may also be used satisfactorily. Applicants have found that one method of forming the internal frame is to heat the above-described PVC tubing at a temperature of 250° F. for approximately 20 minutes, the temperature and heating time being variable relative to each other and to the type of tubing material used. In this heated condition, the section of tubing retains its internal configuration and yet can be molded to the frame shape shown in the drawings by placing the pliable tubing in a jig or mold and allowing it to cool. While the tubing is still warm, an internal column connector or other similar coupling may be inserted into the adjacent open ends of the tubing to connect the ends to each other. Coupling 65 is shown in the lower portion of the pack frame in FIG. 2, and in the upper portion of the pack frame in FIG. 4, and it will be understood that the coupling member may be located at any position along the frame, although preferably at a location on the frame where stress, curvature and flexing are minimized. The substantial unitary configuration of the instant pack frames utilizes the inherent strength of the tubing in providing a lightweight frame which will withstand significant abuse during extended use.

The invention may be embodied in other specific forms without departing from the spirit or central characteristics thereof. The present invention is therefore to be considered in all respects as illustrative and not restrictive, the scope of the invention being indicated by the appended claims rather than by the foregoing description, and all changes which come within the meaning and range of equivalency of the claims are to be embraced therein.

What is claimed is:

1. An internal frame backpack including:

a sack having a compartment for holding goods to be carried;

an envelope of substantially fixed length disposed on the front of said sack, the peripheral edges thereof being closed, said envelope including a tensioned front wall positionable against the back of a wearer and a second rear wall spaced rearward of and fixedly joined along its entire peripheral edge to said first front wall;

tubular internal frame means positioned within said closed envelope under compression, said internal frame means being longitudinally resilient and including a curved portion adapted to contact the rear wall of said envelope and being formed between spaced end portions, said end portions making contact, substantially along their entire length with the longitudinally opposed closed peripheral edges of said envelope whereby said internal frame means cooperates with said peripheral edges to tension the front wall of said envelope to maintain said front wall spaced forward of said rear wall and tending to bias said front wall against deflection by contact with the back of the wearer.

2. The backpack of claim 1 wherein said internal frame means includes a curved upper end portion reactively contacting a correspondingly curved upper edge portion of said envelope; a curved lower end portion reactively contacting a correspondingly curved lower edge portion of said envelope; and an arcuate intermediate portion deformable in response to longitudinal compression of said frame means.

3. The backpack of claim 1 wherein one of said peripheral edges of said closed envelope includes an opening therein extending substantially the entire width of said sack; and fastening means accessible from the exterior of the backpack having an open position and a closed position associated with said opening; said internal frame being adapted to pass through said opening for positioning within said enclosed envelope when said fastening means is open and for compressively loading said frame member thereby tensioning said front wall by the closing of said fastening means.

4. The backpack of claim 3 wherein said fastening means comprises a zipper displosed along the lower peripheral edge of said enclosed envelope, and wherein said zipper is of sufficient length to receive said internal frame therethrough.

5. The backpack of claim 1 wherein a portion of said front wall of said enclosed envelope comprises an open weave mesh material allowing air to circulate over the wearer's back.

6. The backpack of claim 1 wherein each end portion of said internal frame means is generally U-shaped including a transverse portion and curved corners contoured to fit the adjacent closed peripheral edges of said envelope, and wherein said arcuate intermediate portion of said internal frame means includes a pair of inwardly bowed generally C-shaped portions formed between said U-shaped ends, said intermediate portions being shaped to readily deflect inward toward each other when said end portions are compressively loaded by contacting against corresponding upper and lower envelope peripheral edges and said intermediate portion extending rearward of said U-shaped ends to maintain said envelope rear wall spaced rearward of said front wall of said envelope, said front wall being tensioned between said end portions.

7. In a backpack positionable on the back of a wearer having a sack for the storage of goods to be carried and a frame for supporting said sack, the improvement comprising:

frame receiving means disposed on the front of said sack including a tensioned front wall positionable against the back of the wearer and a rear wall formed by the front wall of said sack, the peripheral edges of said front wall and said rear wall of said frame receiving means being joined to form an envelope;

resilient tubular frame means disposed under compression by and located within said frame receiving means, said resilient tubular frame means including laterally extending upper and lower spaced end portions and a curved intermediate portion interconnecting said end portions;

said resilient tubular frame means tensioning said front wall to maintain said front wall spaced forward of said sack and of said intermediate frame portion and tending to bias said front wall against deflection by contact with the back of the wearer.

8. The backpack of claim 7 wherein a portion of said front wall of said frame receiving means comprises an open weave mesh allowing air to circulate over the back of the wearer.

9. The backpack of claim 7 wherein said resilient frame means is formed from a single continuing length of molded plastic tubing joined at its ends.

* * * * *